US005558281A

United States Patent [19]

Bouldin et al.

[11] Patent Number: 5,558,281

[45] Date of Patent: Sep. 24, 1996

[54] RECYCLING AND SOLID MATERIAL CONVERSION APPARATUS

[75] Inventors: Floyd E. Bouldin, 70 Easy St., Box 7177, McMinnville, Tenn. 37110-7177; Thomas E. Cantrell, McMinnville, Tenn.

[73] Assignee: Floyd E. Bouldin, McMinnville, Tenn.

[21] Appl. No.: 353,723

[22] Filed: Dec. 12, 1994

[51] Int. Cl.[6] ..... B02C 13/04; B02C 13/284; B02C 23/24

[52] U.S. Cl. ..... 241/51; 241/73; 241/86.1; 241/88.4; 241/89.2; 241/89.3; 241/189.1; 241/300

[58] Field of Search ..... 241/49, 51, 55, 241/73, 86, 86.1, 88.4, 89.2, 89.3, 189.1, 191, 194, 242, 291, 300

[56] References Cited

U.S. PATENT DOCUMENTS

| | | | |
|---|---|---|---|
| 589,236 | 8/1897 | Williams | 241/88.4 |
| 590,748 | 9/1897 | Williams et al. | 241/88.4 |
| 916,697 | 3/1909 | Gruendler | 241/88.4 |
| 1,044,441 | 11/1912 | Buchanan | 241/189.1 |
| 1,322,210 | 11/1919 | Williams | 241/73 |
| 3,430,873 | 3/1969 | Wahl et al. | 241/55 |
| 4,198,799 | 4/1980 | McGrath | 241/73 |
| 4,706,899 | 11/1987 | Parker et al. | 241/73 |
| 5,199,653 | 4/1993 | Durrant et al. | 241/73 |
| 5,285,974 | 2/1994 | Cesarini | 241/194 |

*Primary Examiner*—Timothy V. Eley
*Attorney, Agent, or Firm*—Rick R. Wascher

[57] ABSTRACT

A motor driven grinding apparatus, and a system incorporating the inventive grinder, for reducing the size of waste material. The apparatus includes a housing having an interior, an exterior, an inlet for introducing material into the interior, and an exit for expelling material from the interior. The housing also includes a front wall, a back wall, a pair of spaced apart side walls, and a bottom grate. The apparatus also includes a substantially cylindrical, balanced, drum having a shaft, and a plurality of cutting blocks rotatably mounted thereto. The drum is rotated by a drive motor engageable with the shaft. An airfoil is attached to the front wall for establishing a static air curtain within the interior of the housing enabling air to be drawn into the housing through the inlet and expelled from the exit when the drum rotates. The drum and cutting block configuration are particularly useful for grinding, and sheafing, cellulose, plastics, glass, and other solid waste materials. The power ratings of the drive motors preferably range from 10 to 200 horsepower. The system includes the inventive apparatus, a series of conveyors, a shredder and at least one magnetic device to remove metallic material from the shredded material.

14 Claims, 7 Drawing Sheets

RECYCLING AND SOLID MATERIAL CONVERSION APPARATUS

BACKGROUND OF THE INVENTION

1. Field of the Invention.

The present invention relates generally to devices and machines used in composting and recycling operations, but more particularly to machines used to grind solid waste into reusable, treatable, or readily degradable forms.

Modern management of discarded materials began in the late 1800's. By the 1890's more than half of America's cities utilized some system of collection and disposal of refuse. The three early categories of refuse were ashes, food and dry rubbish. Each of the three categories had a specific secondary use making what can be referred to as modern day landfills, unnecessary. Food scraps were fed to animals on the farms, the ashes filled potholes in roads and "unhealthy" swamps, and the dry rubbish was sorted for valuables. Rags, paper and the like, made more paper, and metals went back into production as reusable goods or sold.

By the 1930's food scraps, rags and paper were mixed together and canned to an incinerator. Incineration was cheaper and easier because the mixture of materials could be collected at one time and burned together. Incineration, however, introduced harmful byproducts and pollutants into the atmosphere.

In the 1940's, sanitary landfills proliferated. By the 1950's, with the explosion of consumer products focusing on disposability, the amount of refuse generated increased dramatically. In fact, some reports suggest that by the 1970's 5 pounds of garbage per capita were discarded daily as compared to 2.7 pounds in the 1920's. In the 1980's, the public began to appreciate that congested landfills were polluting drinking water. At this time, recycling began its resurgence. Today, what was once something associated with dedicated gardeners or environmental activists, is at the forefront of community living.

Recycling and composting is now being recognized as an efficient way to handle organic solid waste and to reintroduce nutrients into the nutrient depleted soil of the earth. In addition, recycling has transformed discarded materials, such as cellulose, wood, grass, leaves, cardboard, pallets, tree limbs, etc., plastics (polystyrene, polyethylene, polypropylene, PVC, etc.), glass, and ceramics into reusable materials.

2. Description of the Related Art

Hammer mills, grinders, and shredders are three types of machines found in the art to which the invention relates. All three may be used to create compost from organic materials and convert inorganic materials into a reusable or particle form.

Hammer mills incorporate a rotating drum or spindle with free-floating hammers. The hammer mill is designed to spin at a relatively high speed. Material placed in front of the rotating drum is impacted by the hammers. Hammer mills, therefore, do not cut, shred or tear the material, but rely on impact forces to, pulverize the material.

Shredders typically incorporate a pair of rotatable parallel shafts having spaced apart cutters. The cutters resemble flats formed on circular lobes. A first shaft is positioned in parallel alignment with a second shaft enabling the lobes of the first shaft to occupy the interstices between the lobes of the second shaft and vice versa.

The shafts are designed to rotate toward one another. The cutters (flats) pull the material to be shredded downward between the shafts. The pulling action by the cutters shreds the material. In an overload condition, the shafts are designed to reverse direction momentarily before resuming the shredding rotations.

Grinders of the related art incorporate a rotating disk or drum. The drums generally have a flat abrasive surface or have cutters formed integral therewith. To grind material with the related art grinders, the user activates the, rotating drum or disk causing it to spin at high speed. The user then introduces the workpiece into the grinder to contact the rotating drum or disk. The rotating drum cuts, tears, and shreds the workpiece. The hammer mill and shredder are not particularly useful for recycling a variety of materials. That is, each device has its own inherent limitations such that certain materials are processed much more easily than others.

Until now, it is believed that a grinding apparatus for efficiently recycling and converting solid material such as cellulose, plastics, combination materials, glass, ceramics, and other materials into a manageable useful product, such as a fine grade of granule or readily degradable humus, has not been invented.

SUMMARY OF THE PRESENT INVENTION

The present invention is directed to a grinding apparatus and related system for reducing the size of waste material to a useful or easily disposable or degradable form. More specifically, the inventive apparatus is a grinding machine used in recycling or composting operations. The apparatus can be used in a stationary composting or recycling system, or a down-sized version can be portable for home or light industrial use. The invention, therefore, includes the grinding apparatus and its components.

The invention includes a balanced motor-driven cylindrical drum with removable teeth, a grate component, a housing, an airfoil and other components. The housing has an inlet and an exit. The drum is designed to rotate in a direction away from the inlet portion of the invention housing. The grate regulates the particulate size of the ground material, and the airfoil establishes a static air curtain around the drum in the interior of the housing. The static air curtain allows the rotating drum to draw air in through the inlet and expel it through the exit.

The choice of motor is not considered critical, as any suitably configured electric or fuel powered motor can be used. The preferred power rating of the motor, however, should be from 2 to 500 horsepower, but preferably within the range 10 to 200 horsepower.

The preferred embodiment of the drum has a drive shaft positioned and extending from the ends of the drum along its central axis of rotation. The drum shaft may simply be attached to the ends and does not necessarily have to extend the longitudinal length (width) of the drum. The drum shaft may also occupy a shaft receiving bore formed in a central portion of the drum so long as the shaft protrudes from the ends.

In addition, the drum may be rotated by a direct link to a motor shaft. Such a direct link should be accomplished by a keyway to receive a rotatable keyed motor shaft. A direct link with a keyed motor shaft, however, is known to present significant safety hazards during operation.

One end of the preferred shaft arrangement is received in a roller bearing support for holding the drum in proper horizontal alignment with the motor and housing, and the other end is received within and protrudes from a beating housing and is equipped with a pulley. A corresponding drive pulley is also associated with the motor shaft. A drive belt engages the pulley configuration.

The selection of a preferred belt configuration depends upon several factors. Such factors as positive grip without slippage, minimal stretch, and overall belt strength must be considered. The preferred drive pulley is a high torque timing belt, but may also be a series of individual belts used in combination.

Of course, a single strand belt of varying thickness and materials may be used, or it is also possible to fit a sprocket and chain drive to the motor and drum. A pulley bushing maintains the pulley and belt system in its installed position with respect to the drive portion of the motor and drum shaft.

The exterior surface of the central section of the preferred drum is equipped with a series of rings having a planar surface and an edge. The rings are rigidly attached to the central section and positioned in spaced relation. In the preferred embodiment, the tings have a plurality of holes formed in the planar surface. The holes of adjacent tings are aligned horizontally to provide axially aligned rows of holes.

A rod is positioned within each axially aligned row. The rods are parallel with the central section of the drum. Cutting blocks are positioned in the space between rings by threading the rod through an aperture in the proximal end of a cutting block. The cutting blocks are preferably positioned in a staggered relationship in the spaces between adjacent rings.

The preferred embodiment of the cutting blocks are designed to have a fastener receiving bore. In the preferred embodiment, the bore receives an anchor bolt having a smooth shank portion, a distal threaded portion and a proximal head portion. The distal threaded portion is designed to engage a central tapped bore of a rectangular tooth.

It is also contemplated as part of the present invention to form a shank directly on each tooth component and attach each tooth directly to a cutting block with a nut or other fastener. Alternatively, the cutting block may have an integral tooth.

The preferred embodiment of each tooth has a rectangular shape with a leading edge and a trailing edge, and is concave between the edges. The upper edge of the tooth is considered the leading edge. The lower edge of the tooth is the trailing edge.

The concave shape of the tooth component provides enhanced grinding and longer tooth life. The rectangular shape of the tooth helps to prevent its rotation with respect to the cutting block on which it is mounted. The teeth therefore are designed to maximize efficiency of the drum.

After successive grinding operations should the leading edge of the tooth become dull, or rounded, the user simply unscrews the anchor bolt from the tooth, rotates the tooth 180° and reinstails the tooth by reintroducing the threaded anchor bolt into the central tapped bore of the tooth. Accordingly, the reversible tooth arrangement extends the component life of the tooth.

It is contemplated that a four-sided tooth could be used, however, if the tooth is removed and rotated 90° at least one corner would show the wear of the former leading edge.

Of course, the teeth may also have any of the following shapes: circular, oval, elliptical, triangular, and still be considered with the scope of the present invention.

In operation, the material to be ground is introduced into the housing and is thrown forward by the drum and the vacuum created by the rotating drum. The cooperating combination of the teeth and grate generate extremely high shearing forces which grind the material.

The teeth and grate cooperatively continue the shearing operation on any given piece of material until its particle size or humus is small enough to pass through the apertures in the grate. As mentioned above, the size of the particulate matter ejected from the grinder is regulated by the size of the apertures in the grate.

A roller assembly may be used in place of the grate. The roller assembly has proven particularly useful with hard materials such as ceramics.

The preferred roller assembly comprises a plurality of spaced apart rollers held in parallel alignment with one another by an arcuate frame and bridge means. The preferred configuration of the rollers include a stationary rod and a rotating sleeve surrounding the stationary rod.

The ground material must pass between adjacent rollers to be discharged. Material too large to pass between the rollers, is re-routed into the material receiving housing of the invention to be ground again.

It is further contemplated that the roller assembly may comprise additional elements such as a section of screen, or the like to assist with the sifting and regulating of the particle size of the material discharged.

The housing of the invention can also incorporate mist introducing atomizers. The mist generating atomizers are provided to spray water into the housing to help reduce the amount of airborne dust particles and cool, as well as lubricate, the grinder.

A soft start or clutch mechanism may also be incorporated with the present invention. A clutch or soft start feature is provided to extend the life of the motor and prevent the belts from slipping upon start-up.

In fact, with respect to the preferred embodiments of the invention incorporating a motor of 20 horsepower or more, an amperage meter is used to monitor the load on the motor. Monitoring the load on the motor is another means to extend motor life.

Accordingly, the invention can be described in a variety of ways, one of which is: a grinding apparatus for reducing the size of waste material, comprising: a housing having an interior, an exterior, an inlet for introducing material into the interior, and an exit for expelling material from the interior, further comprising: a front wall having a substantially vertical portion in communication with an arcuate portion, a back wall, a pair of spaced apart side walls, and a bottom grate; a substantially cylindrical drum means for reducing the size of waste material, comprising: a cylindrical central section having spaced apart ends and an axis of rotation, shaft means extending from the spaced apart ends for rotating the drum means about the axis, a plurality of cutting blocks, and ring means rigidly attached to the central section for pivotally supporting the cutting blocks; drive means engageable with the shaft means for rotating the shaft means; airfoil means attached to the arcuate portion of the front wall in the interior of the housing and vertically aligned above and positioned substantially parallel to the axis of rotation, for establishing a static air curtain within the interior of the housing enabling air to be drawn into the housing through the inlet and expelled from the exit when the drum means rotates.

The grate component may further include an arcuate platform, having a plurality of apertures formed therein, positioned between a pair of spaced apart side frame members. The ring means may further include a plurality of rings attached to central section is spaced apart parallel relationship, and a plurality of rods transversely attached to the rings parallel to the axis of rotation. The cuttings blocks further include a proximal end and a distal end, and each cutting block is rotatably attached at its proximal end to one of the plurality of rods. The tooth means may be operably and removably positioned at the distal end of the block for reducing the size of waste material, and may further comprise an edge having a surface treated with a coating to increase the hardness of the edge. The drum is preferably balanced with respect to the shaft means, and the shaft means is rotatably attached to the spaced apart side walls.

The system of the present invention may be summarized in a variety of ways, one of which is: a system for recycling waste material, comprising: means for shredding waste material including metallic and non-metallic material; grinding means for grinding reducing the size of the shredded waste material; first conveyor means for carrying the shredded waste material to the grinding means; magnetic roller means for separating the metallic material from the non-metallic material; second conveyor means for transporting the ground material expelled from the grinding means.

The system may also include magnetic conveyor means for removing metallic material from the first conveyor means; and chute means for diverting metallic material removed from the non-metallic material.

Is it an object of the present invention to provide an improved grinding and recycling apparatus for solid material, such as cellulose and vegetation, glass, plastic, man-made materials, ceramics, etc.

Further, until now it is believed that a grinder having a means to gauge and regulate the particle size emitted from the grinder has not been invented.

It is an advantage of the present invention to provide a means of regulating the particle size of the ground material discharged from the inventive grinding apparatus disclosed herein.

It is an advantage of the present invention to equip a rotating drum with removable and reversible teeth for grinding solid material.

Still further, until now it is believed that a grinder having a rotating drum with a system of cutting elements including a tooth component, and a cutting block component has not been invented.

Still further, until now it is believed that a grinder having a means for minimizing the dust or air born particulates generated by a grinding apparatus, and provide a means to lubricate and cool the apparatus during the grinding operation has not been invented.

It is another advantage of the present invention to provide a means for minimizing the dust or air born particulates generated by a grinding apparatus.

It is an object of the present invention to provide a grinding apparatus with an airfoil to create a static air curtain within the housing.

These and other objects and advantages will become apparent after consideration of the description and claims set forth below.

DETAILED DESCRIPTION OF THE PREFERRED EMBODIMENT

Figure 1A:
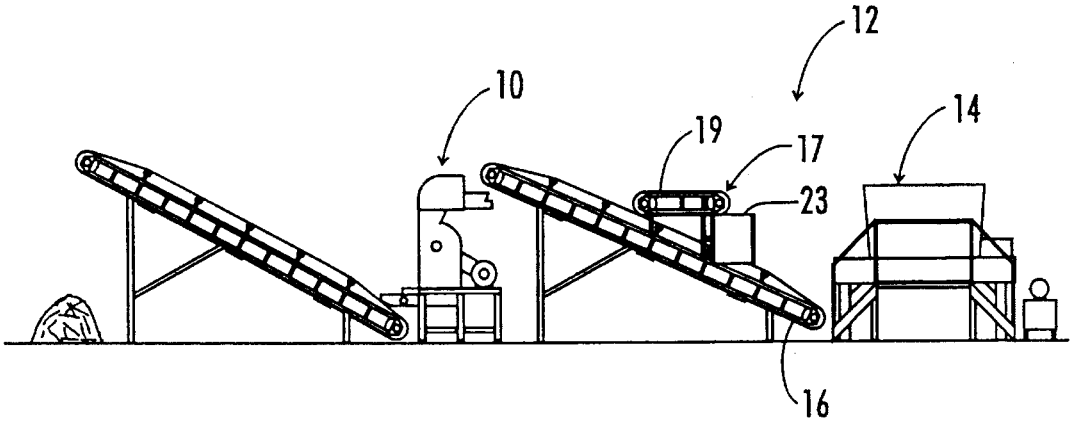
FIGS. 1A and 1B are side perspective views of an embodiment of the inventive system incorporating the inventive grinder.
Figure 1B:
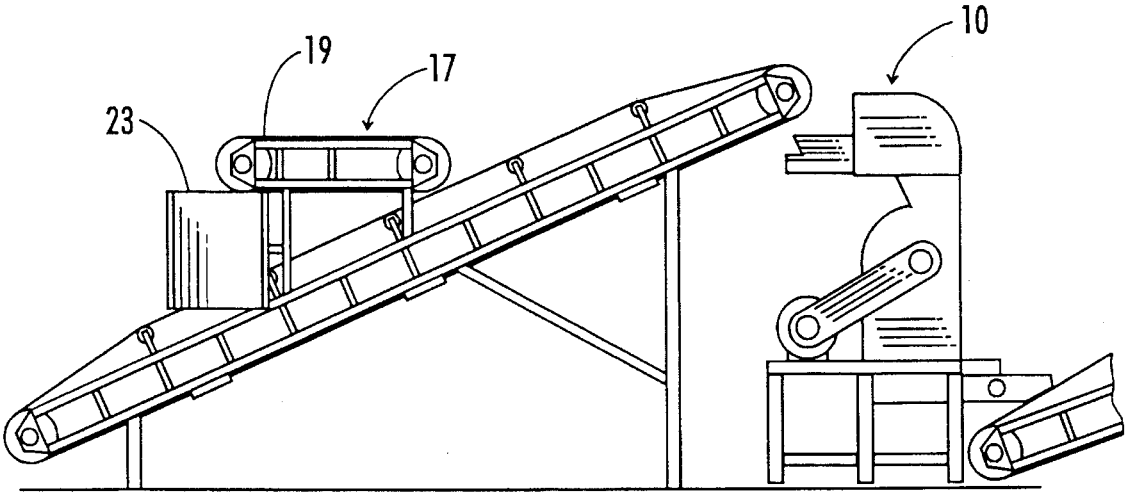

An inventive grinding apparatus is designated generally by reference numerals 10 and 30 of FIGS. 1A, 1B, 2 and 3. Grinding apparatus (hereinafter "grinder") 10 shown in FIGS. 1A–B and 3 comprises a component part of a compost or recycling system 12 (FIG. 1A). Ideally, the system includes two inventive grinders.

The grinders 10 and 30 are substantially similar, but may vary according to the configuration of their individual components such as the drum, cutting blocks and teeth, wheeled carriages etc. The possibility of variation in the components will become apparent after consideration of the alternate embodiments disclosed herein.

In the complete system, generally one grinder is used for an organic loop of the system, and the other for an inorganic loop of the system. The "organic path" is provided for the treatment of organic material, and the "inorganic path" for the treatment of inorganic material, such that organic and inorganic grinding operations can occur in rapid succession within the same system. Of course, a single grinder could be used to accomplish the same task by cycling the processing of organic and inorganic material.

In either case, organic or inorganic material may be introduced into the shredder 14 and shredded. The shredded material is ejected from the shredder and travels along conveyor 16 beneath conveyor 17 having a roller 19 to grinder 10. Roller 19 is preferably magnetized to remove metallic debris from the shredded material supply prior to introduction into the grinder 10. Chute 23 diverts the metallic material picked up by roller 19 and transported by conveyor 17 out of the system 12. The grinder 10 (or 30 of FIG. 2) operates in accordance with the mode of operation set forth below and grinds the material introduced therein.

Figure 2:
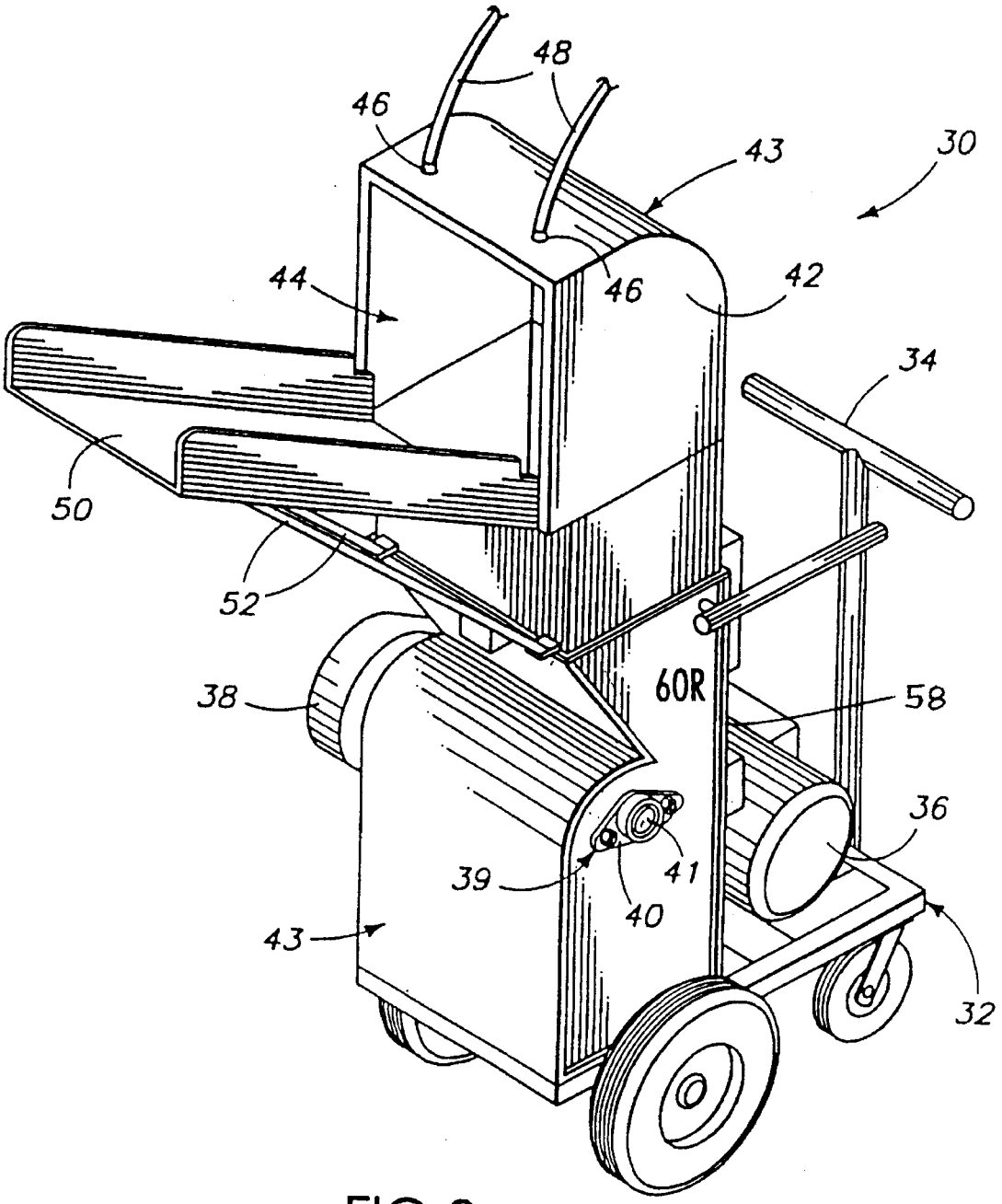
FIG. 2 is a rear perspective view of an embodiment of a portable version of the inventive grinder.
Figure 3:
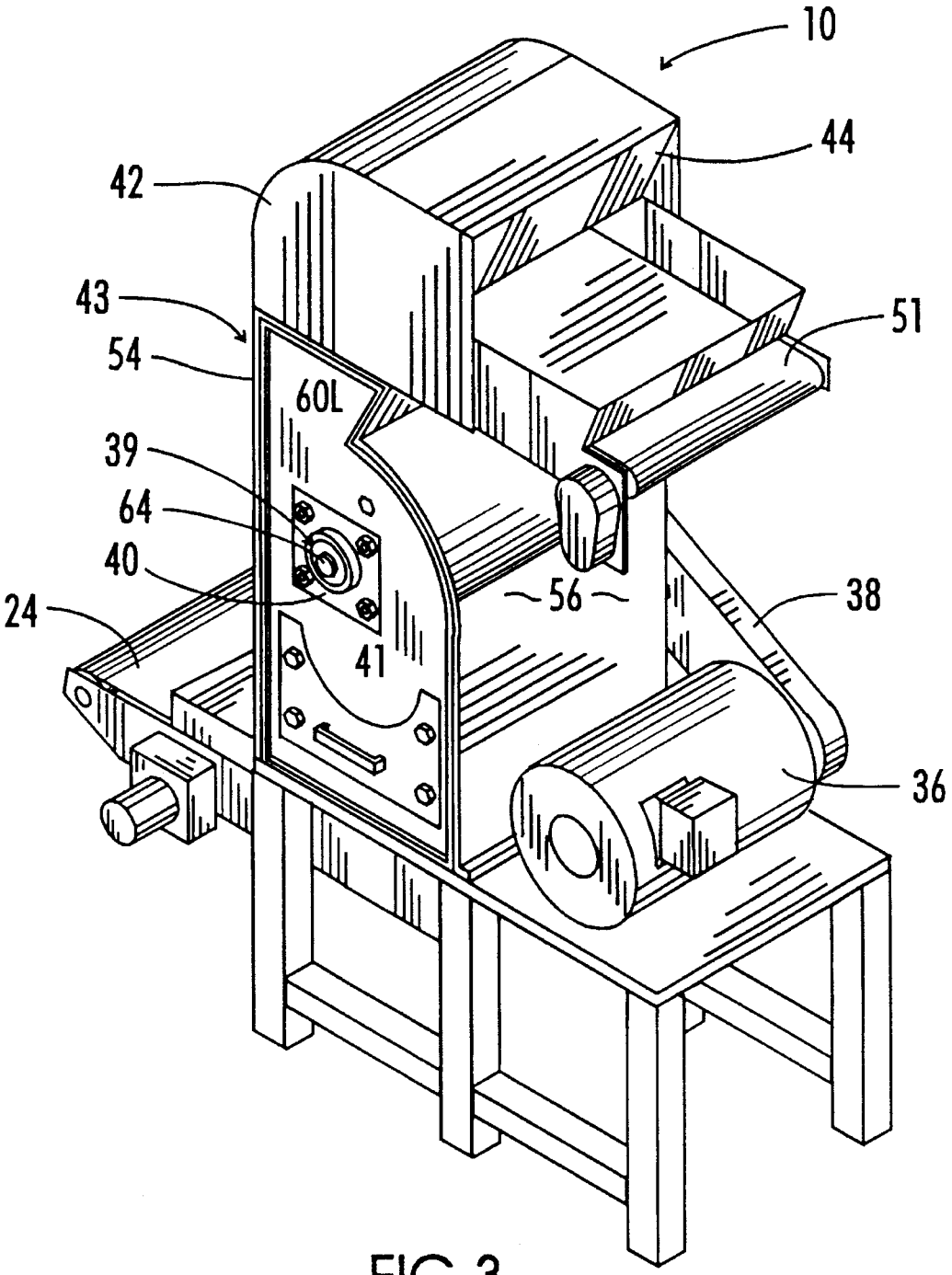
FIG. 3 is an elevated perspective view of a stationary embodiment of the inventive grinder.

With reference to FIGS. 2 and 3., the grinder is driven by a motor 36 (FIGS. 2–3), and the ground material is ejected from the grinder onto conveyor 24 for delivery to, for example, a material pile or truck.

A portable embodiment of the inventive grinder is shown in FIG. 2, and designated generally by reference number 30. The portable embodiment of the grinder is substantially identical to the stand alone embodiment of the grinder (FIG. 3 ), but also includes a wheeled cart 32 and typically lower power ratings than the stand-alone embodiment. The portable grinder incorporates the same inventive components of the invention as the stand alone grinder, even though the configuration of the components, owing to the various embodiments thereof, may differ.

The portable grinder 30 is, therefore, mounted on a wheeled cart 32. Handle 34 of the wheeled cart 32 is used to pull the wheeled cart to the site where the grinding operations will be carried out. Motor 36 drives the grinder. Belt cover 38 houses the belt assembly and pulleys (not visible). In the preferred embodiments, a high torque timing belt or a multi-strand belt system is fitted to the pulleys. Belt cover 38 is used as a protective shroud for the rotating pulley and drive belt components.

Roller bearing support 39 is used to help maintain a belt driven drum in proper alignment with the housing, and includes a housing component 40 and a roller bearing component 41. A removable hood 42 of the housing 43 covers the entry 44 of the grinder. Optional Atomizers 46 having fluid hoses 48 fitted thereto are attached to the hood 42. An optional chute 50 having support 52 is provided as a means to more easily introduce material into the entry 44. Chute 50 may also include a material feed conveyor 51 (FIG. 3) to assist in the introduction of material.

The atomizers are optional, but are particularly useful for introducing a fine liquid mist into the entry way of the grinder, so as to minimize the generation of dust during grinding operations. The atomizers also serve to introduce a fluid lubricant and coolant, preferably water, into the housing 43.

With reference to FIGS. 2 and 3, housing 43 also includes a main cabinet 54, comprised of a front wall 56, a rear wall 58, spaced apart walls 60L and 60R. Rear wall 58 may include a pivoting access door (not shown) which, when open, exposes the interior 61 of the housing 43 as shown in FIG. 4.

Figure 4:
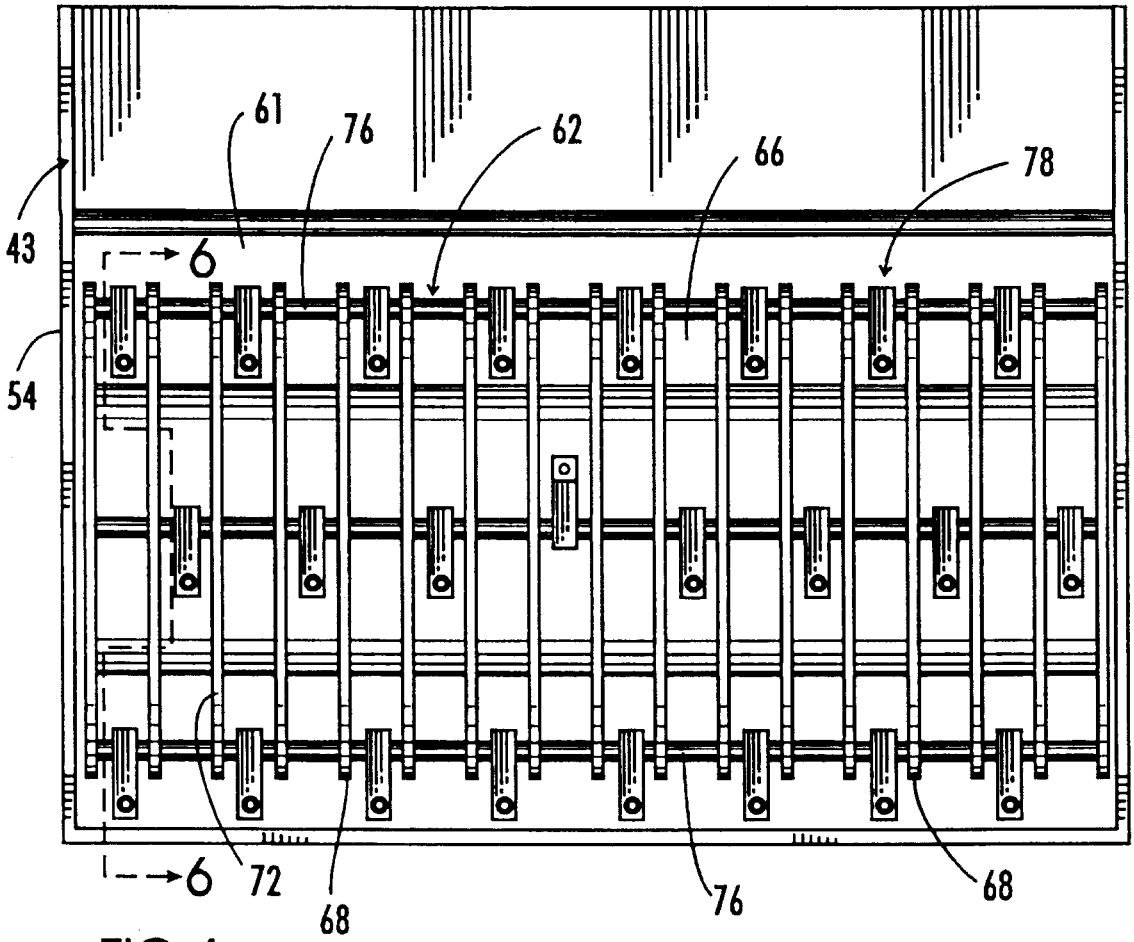
FIG. 4 is a front perspective view of an embodiment of the drum component of the inventive grinder.
Figure 5:
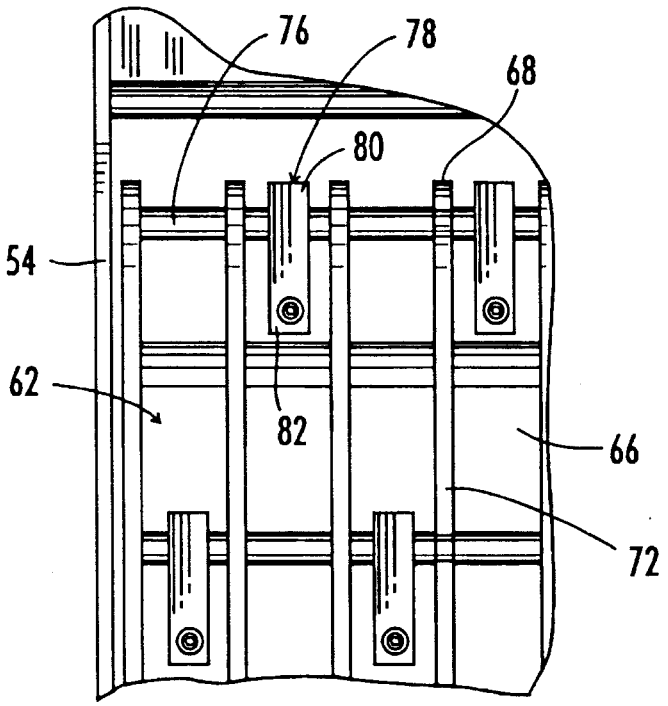
FIG. 5 is an enlarged partially fragmented view of the drum shown in FIG. 4.

With reference to FIGS. 4 and 5, a rotatable drum, designated generally by the reference numeral 62 is contained within the cabinet 54. Drum drive shaft 64 (FIG. 3) protrudes from the cabinet 54 and is received by the roller bearing 39. The roller bearing assembly 39 is provided to help maintain the appropriate drive alignment with the drive motor 36.

Drum 62 is comprised of a central section 66 and a plurality of spaced apart rings 68 rigidly attached thereto. Rings 68 are spaced apart and have a planar surface 70 (FIGS. 6 and 7) and a peripheral edge 72. In addition, rings 68 have a plurality of holes (not visible) which are axially aligned to form rows in order to accommodate a plurality of rods 76 therethrough.

Figure 6:
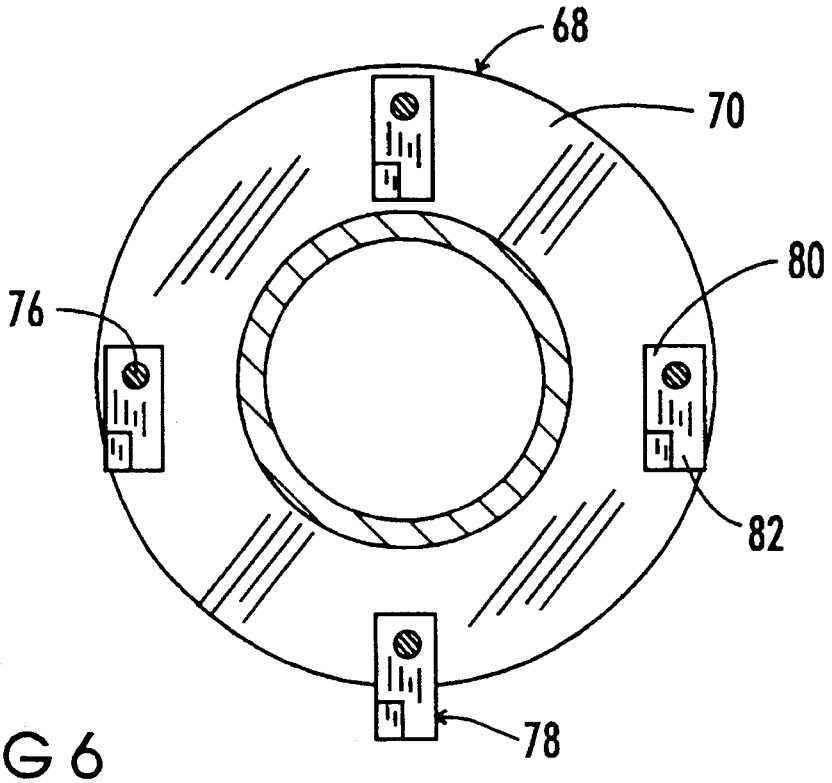
FIG. 6 is a side view of the dram component of FIG. 4 shown with the cutting blocks in a rest position.
Figure 7:
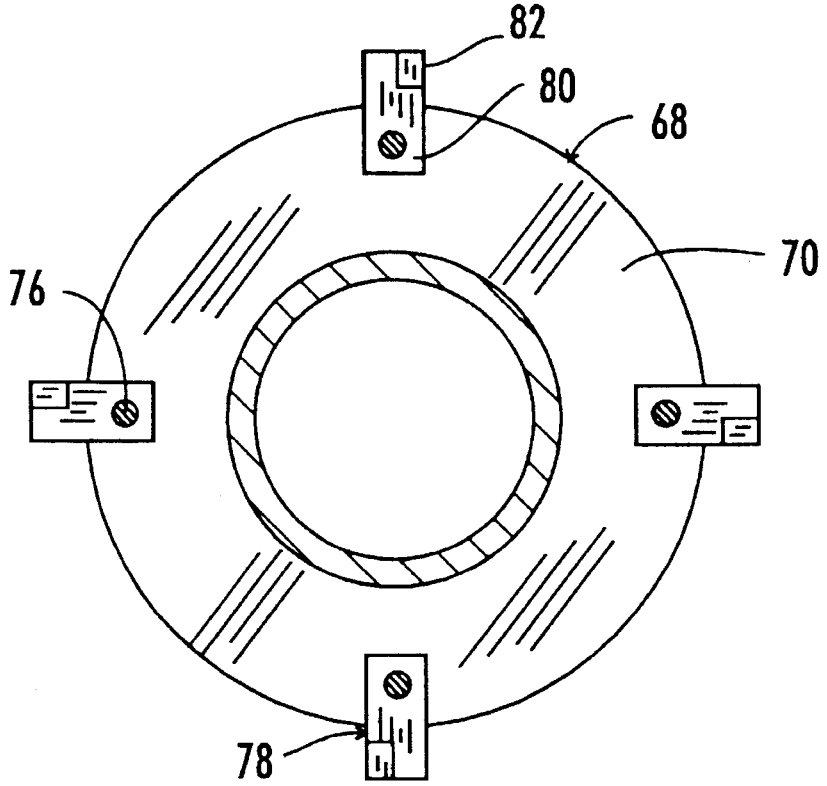
FIG. 7 is a side view of the drum component of FIG. 4 shown with the cutting blocks in an operating position.

A plurality of cutting blocks 78 having a proximal end 80 and a distal end 82 are pivotally mounted to the rods by passing a rod 76 through the bores 79 at the proximal end 80 of the cutting block 78 (FIGS. 6 and 7). As shown in FIG. 7, the cutting blocks are raised in an upright operable position. FIG. 6 illustrates the blocks 78 in a rest position to further demonstrate their ability to pivot on the rods 76.

Figure 8:
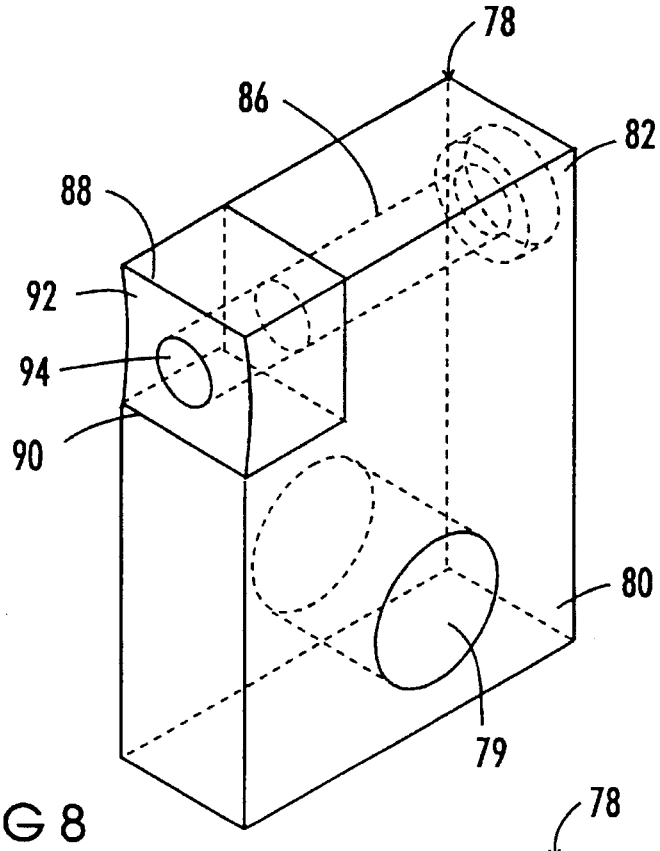
FIG. 8 is an elevated perspective view of an embodiment of the cutting block of the present invention.
Figure 9:
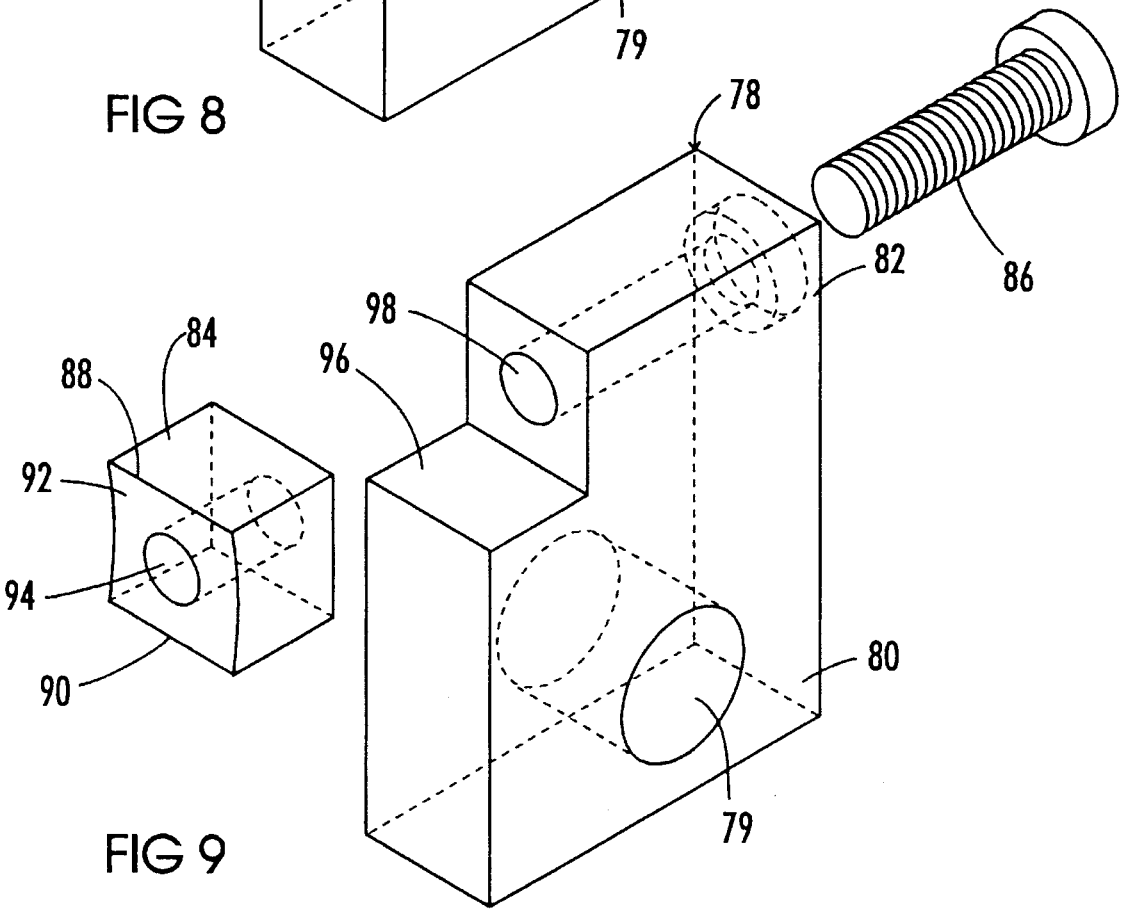
FIG. 9 is an exploded perspective view of the cutting block shown in FIG. 8.
Figure 10:
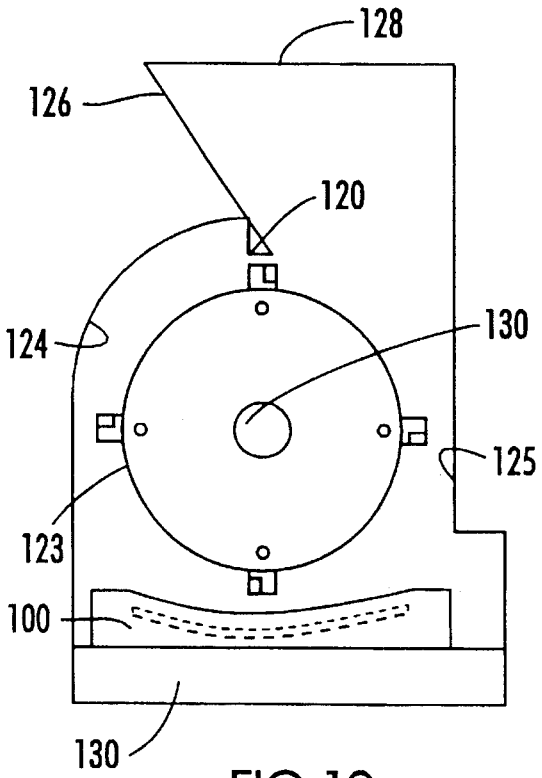
FIG. 10 is a side representational view of the airfoil bar illustrated in FIGS. 4 and 5 and its relation to the housing and drum component of the invention.
Figure 11:
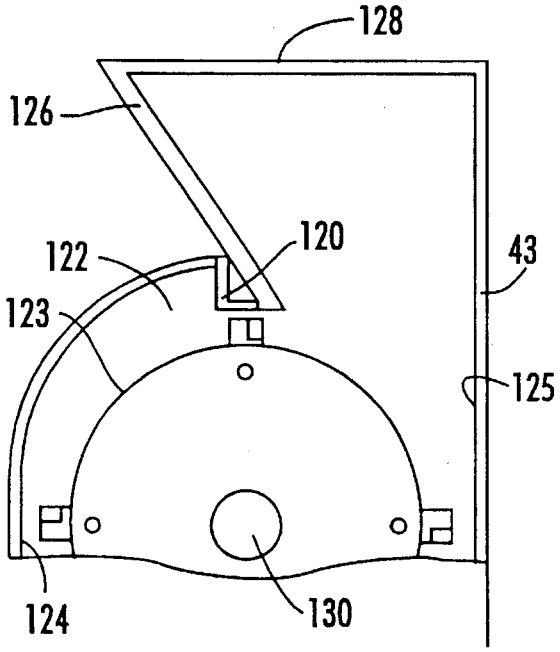
FIG. 11 is an enlarged partially fragmented view of the drum and airfoil shown in FIG. 10.

With reference to FIGS. 8 and 9, teeth 84 are mounted to the distal end 82 of the block 78. The tooth is attached to the block by a set screw 86 (shown in the dashed lines of FIG. 8). Each tooth has a leading or top edge 88 and a bottom or trailing edge 90 (see FIGS. 5 and 7).

In addition, each tooth preferably has a concave face 92 and a tapped bore 94 for receiving the set screw fastener such as a conventional screw or the like 86. Each tooth is fitted to the cutting block 78 so as to rest in a cut-away portion 96 in order that bore 98 of the cutting block 78 aligns with the tap bore 94 of the tooth 84. In this fashion, as the teeth become worn, they can be replaced at the discretion of the operator. The teeth are preferably formed from tool steel and coated with tungsten carbide.

Alternatively, the teeth can be manufactured from a steel alloy, or any other type of tool steel, and can be micro-coated so as to improve the hardness characteristics of the material. In addition, it is advantageous to supply the operator with a variety of differently configured teeth which have proven to be more successful in the grinding of a variety of materials, such that a ceramic material with its inherent hardness would require a harder, stronger tooth than a tooth used for grinding cellulose and plastics.

An important structural feature of the present invention is an airfoil, designated generally by the reference numeral 120, which is particularly useful for establishing a static air curtain within housing 43 surrounding the drum 62. It is also important to point out that air space 122 provides clearance between the drum surface 123 in the interior of the front wall 124 and back wall 125.

Air foil flange 120 essentially extends the angled region 126 of the inlet 128 of the grinder. The airfoil is positioned vertically above an axis of rotation 130. With the air foil 120 positioned in the manner as shown in the figures, the static air curtain surrounding the drum enables a rotating drum to induce a vacuum at the inlet 128 thereby causing loose particulate matter and dust to be drawn into the housing and prevented from exiting the inlet 128 during a grinding operation. In this fashion, material is expelled from the grinder through the grate 100 and out the exit 130.

In operation, air flowing out of the exit 130 appears to be blown while the grinder is in operation. The air foil, therefore, assists in the grinding operation in that the matter is drawn downward into contact with drum 62 which grinds the material against the grate 100 causing it to be expelled from the housing 43 through the apertures 106 of the arcuate intermediate portion 104 of the grate 100.

Figure 12:
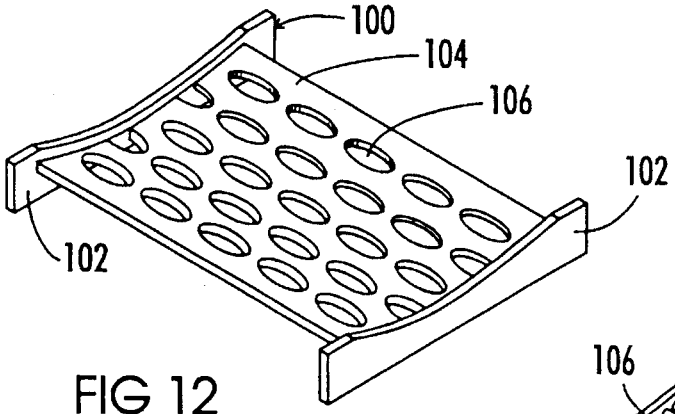
FIGS. 12 and 13 are elevated perspective views of embodiments of the grate component of the present invention.
Figure 13:
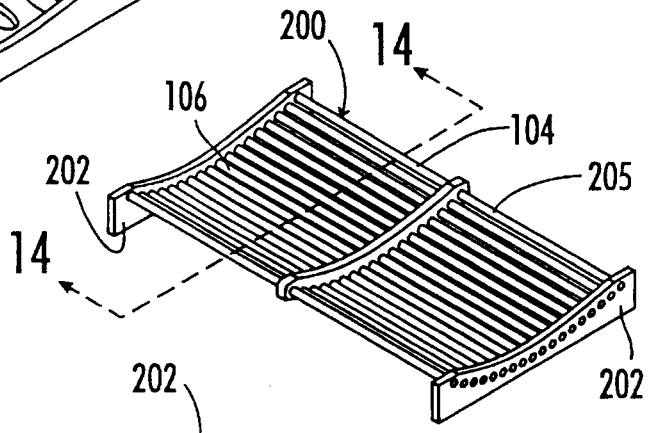
Figure 14:
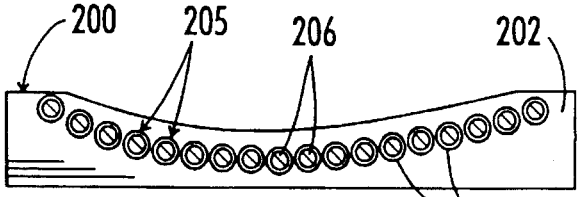
FIG. 14 is a cross-sectional view of the grate shown in FIG. 13 taken along line A—A of that figure.

With reference to FIGS. 12–14, grate 100 comprises a pair of spaced apart frame segments 102 and a central perforated, arcuate, grid 104 rigidly mounted between the frame segments 102. Perforations 106 can be elliptical as shown in FIG. 8A, or circular, as well as vary in size depending upon the desired site of the ground material.

The small apertures of grate cause the grinder to continuously grind the material until it fits through the apertures. Thus, the operator may control the particulate size of the resultant material by selection of the appropriate grate having the appropriate aperture size. Accordingly, grate 100 is removable from the housing 43.

With reference to FIGS. 13 and 14, a roller grate embodiment is shown. The roller grate, designated generally by the reference numeral 200, includes spaced apart side frame portions 202 and rollers 205. Rollers 205 are comprised of pins 206 and sleeves 208. Sleeves 208 are slipped over the pins 206, thereby enabling the sleeves to rotate with respect to the pins.

Although the inventive grinder and it components have been shown and described in what is considered to be the most practical and preferred embodiments, it is recognized that departures may be made therefrom within the scope of the invention, which is not to be limited per se to those specific details as disclosed herein, but is to be accorded the full scope of the claims so as to embrace any and all equivalent devices, and apparatuses.

What is claimed is:

1. A grinding apparatus for reducing the size of waste material, comprising:

a housing having an interior, an exterior, an inlet for introducing material into the interior, and an exit for expelling material from the interior, further comprising:

a front wall having a substantially vertical portion in communication with an arcuate portion, a back wall, a pair of spaced apart side walls, and a bottom grate positioned adjacent to the exit of the housing; substantially cylindrical drum means for reducing the size of waste material, comprising:

a central section having spaced apart ends and an axis of rotation, shaft means extending from the spaced apart ends for rotating the drum means about the axis, a plurality of cutting blocks, and ring means rigidly attached to the central section for pivotally supporting the plurality of cutting blocks;

drive means engageable with the shaft means for rotating the shaft means;

airfoil means attached to the arcuate portion of the front wall in the interior of the housing and vertically aligned above and positioned substantially parallel to the axis of rotation, whereby a static air curtain is established within the interior of the housing enabling air to be drawn into the housing through the inlet and expelled from the exit when the drum means rotates.

2. The apparatus of claim 1, wherein the gate further comprises:

an arcuate platform positioned between a pair of spaced apart side frame members and having a plurality of apertures formed in the arcuate platform.

3. The apparatus of claim 1, wherein the ring means further comprises:

a plurality of rings attached to the central section in spaced apart parallel relationship, and a plurality of guide rods transversely attached to the rings parallel to the axis of rotation for supporting the cutting blocks.

4. The apparatus of claim 3, wherein each of the plurality of cutting blocks further comprises:

a proximal end and a distal end wherein each cutting block is rotatably attached at its proximal end to one of the plurality of rods and each cutting block is sized to freely rotate between two adjacent rings but prevented from rotating through a 360 degree arc by the central section.

5. The apparatus of claim 1, wherein the cutting blocks further include:

tooth means operably and removably positioned at the distal end of the block for reducing the size of waste material.

6. The apparatus of claim 5, wherein the tooth means further comprises:

an edge having a surface treated with a coating to increase the hardness of the edge.

7. The apparatus of claim 1, wherein:

the drum means is balanced with respect to the shaft means.

8. The apparatus of claim 1, wherein:

the shaft means is rotatably attached to the spaced apart side walls.

9. The apparatus of claim 1, further including:

an air space surrounding the drum means, and the airfoil means is a flange extending from the interior surface of the front wall into the air space.

10. A grinding apparatus for reducing the size of waste material, comprising:

a housing having an interior, an exterior, an inlet for introducing material into the interior, and an exit for expelling material from the interior, wherein the interior is defined by a front wall, a back wall, a pair of spaced apart side walls, a bottom grate and the inlet;

a substantially cylindrical drum rotatably attached to the spaced apart side walls within the interior of the housing, wherein the drum further includes:

a substantially cylindrical central section having spaced apart ends and a shaft means for rotating the drum about an axis, wherein the shaft means extends from the spaced apart ends along a vertical centerline of the central section;

a plurality of spaced apart rings rigidly attached to the central section, wherein each ring has a planar surface, a circular periphery, and a plurality of holes spaced apart around the planar surface and axially aligned as between adjacent rings to form a plurality of transverse rows of apertures parallel to the central section, and a plurality of rods positioned within the plurality of apertures of adjacent rings and parallel to the central section;

a plurality of cutting blocks, wherein each cutting block further comprises:

a proximal end and a distal end, wherein each cutting block is rotatably attached at it proximal end to one of the plurality of rods in between adjacent rings, and removable tooth means operably positioned at the distal end of the block for reducing the size of waste material;

drive means engageable with the shaft means for rotating the drum;

airfoil means attached to the front wall in the interior of the housing and vertically aligned and positioned substantially parallel to the axis, whereby a static air curtain is established within the interior of the housing enabling air to be drawn into the housing through the inlet and expelled from the exit when the drive means rotates the drum.

11. The apparatus of claim 10, wherein the tooth means further comprises:

an edge having a surface treated with a coating to increase the hardness of the edge.

12. The apparatus of claim 10, wherein:

the drum means is balanced with respect to the shaft means.

13. The apparatus of claim 10, wherein the grate further comprises:

an arcuate platform, having a plurality of apertures formed therein, positioned between a pair of spaced apart side frame members.

14. The apparatus of claim 10, further including:

an air space surrounding the drum, and the airfoil is a flange extending from the interior surface of the front wall into the air space.

* * * * *